US007457199B2

(12) United States Patent
Purcell et al.

(10) Patent No.: US 7,457,199 B2
(45) Date of Patent: Nov. 25, 2008

(54) SHEAR MODE FOLDED SHELL PROJECTOR

(75) Inventors: Christopher John A. Purcell, Dartmouth (CA); Richard A. Fleming, Dartmouth (CA)

(73) Assignee: Her Majesty the Queen as represented by the Minister of National Defence of her Majesty's Canadian Government, Ontario (CA)

( * ) Notice: Subject to any disclaimer, the term of this patent is extended or adjusted under 35 U.S.C. 154(b) by 0 days.

(21) Appl. No.: 11/366,821

(22) Filed: Mar. 3, 2006

(65) Prior Publication Data

US 2006/0198247 A1 Sep. 7, 2006

Related U.S. Application Data

(60) Provisional application No. 60/657,725, filed on Mar. 3, 2005.

(51) Int. Cl.
*H04R 17/00* (2006.01)

(52) U.S. Cl. ..... 367/163

(58) Field of Classification Search ..... 367/163
See application file for complete search history.

(56) References Cited

U.S. PATENT DOCUMENTS 1,590,311 A * 6/1926 McL. Nicolson ..... 367/163
5,805,529 A 9/1998 Purcell

* cited by examiner

*Primary Examiner*—Dan Pihulic
(74) *Attorney, Agent, or Firm*—Ross F. Hunt, Jr.; Stites & Harbison PLLC

(57) ABSTRACT

An acoustic projector with a thin walled shell extending between flanges having helicoidal corrugations extending between the flanges. A shear mode motor is coupled to the thin walled shell to provide a torque to the thin walled shell.

9 Claims, 3 Drawing Sheets

SHEAR MODE FOLDED SHELL PROJECTOR

This Claims benefit of Provisional Application Ser. No. 60/657,725 filed on 3 Mar. 2005.

FIELD OF THE INVENTION

The present invention relates to acoustic projectors for use in sonar systems and in particular to underwater flextensional projectors having an improved coupling factor between a drive motor and a shell.

BACKGROUND OF THE INVENTION

U.S. Pat. No. 5,805,529, which is incorporated by reference, describes one type of flextensional projector referred to as a Folded Shell Projector having reduced depth sensitivity and increased thermal conductance to the surrounding fluid by using a one-piece thin walled folded shell as a radiating surface.

The acoustic projector described in U.S. Pat. No. 5,805,529 has a pair of spaced apart end plates with a piezeoelectric driver positioned between the end plates, the driver having smaller cross-sectional dimensions than the end plates which have edges secured to an outer one-piece thin walled shell that provides an enclosure for the driver, the thin walled shell having a concavely inwardly bent surface between the end plates and a plurality of axially extending corrugations to provide a predetermined axial compliance and radial to axial transformation ratio.

SUMMARY OF THE INVENTION

It is an object of the present invention to provide an acoustic projector with an improved coupling factor between a driver motor and a shell.

BRIEF DESCRIPTION OF THE DRAWINGS

The invention will now be described in more detail with reference to the accompanying, in which.

DESCRIPTION OF A PREFERRED EMBODIMENT

Figure 1:
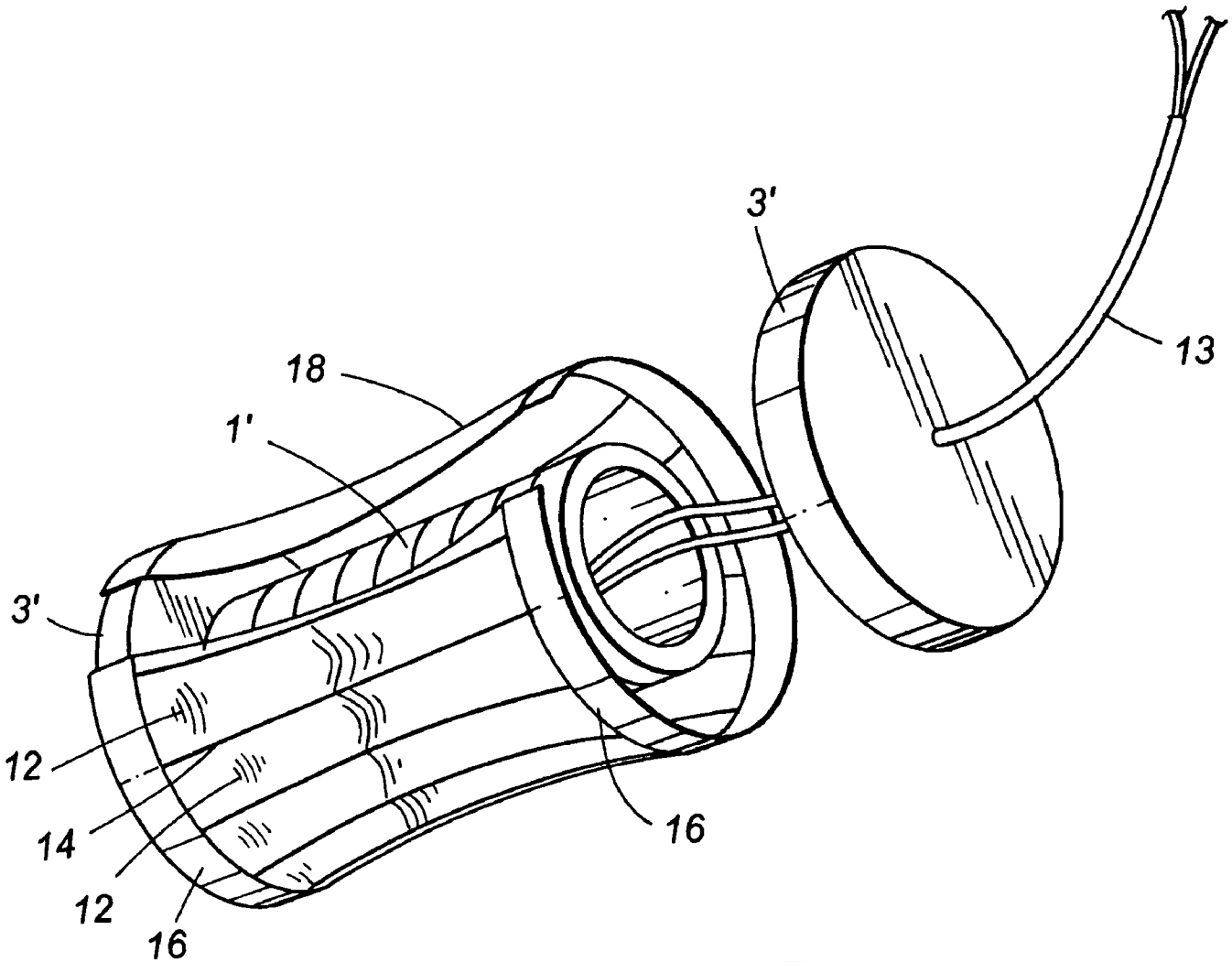
PRIOR ART FIG. 1
FIG. 1 is a perspective view of a known folded shell projector with one fold removed to illustrate its interior.

U.S. Pat. No. 5,805,529, which is incorporated by reference, describes one type of acoustic projector, a folded shell projector, which is illustrated in FIG. 1. In this known folded shell projector a pair of spaced apart end plates 3' has a piezoelectric driver 1' positioned between end plates 3'. The top end plate 3' has it edges secured to a thin walled shell 18 at flange 16 in the fully assembled projector. The driver 1' has a smaller cross-sectional dimension than the shell 18 which provides an enclosure for the driver, the ends plates having edges secured to the thin walled shell 18 at flanges 16. The thin walled shell 18 has a concavely inwardly bent surface between the end plates 3' and a plurality of axially extending corrugations 12 which provides a predetermined axial compliance and radial-to-axial transformation ratio.

Piezoelectric materials as used in U.S. Pat. No. 5,805,529 are commonly used in a mode where their poling direction, the applied electric field, and the generated stress are all collinear. Piezoelectric materials have their highest sensitivity however, in shear mode. In this mode of operation the poling direction and applied field are orthogonal, and a shearing strain develops about the axis perpendicular to the plane containing the polarization and applied field. The piezoelectric constant d15, which describes the shear sensitivity in m/volt can be 1.7 times that of d33 for typical piezoceramics. The recently discovered single crystal relaxor ferroelectric materials have their highest sensitivity and coupling factor in shear mode. The highest coupling factor ever reported for any active material is 0.98 for k15 in these materials. A search turned up no examples of a sound projector design that capitalizes on this high shear coupling factor.

Shear motion of a solid to fluid interface does not generate sound in the fluid. To employ a shear mode motor as an acoustic source requires a transformation of shear motion to a motion that will produce a volume velocity.

Theoretically 33 mode driven sound projectors have lower sensitivity and narrower bandwidth than shear mode driven projectors. In the case of single crystal reflexor ferroelectrics, the full potential of the material for wide bandwidth sources will not be realized unless the shear mode can be utilized.

Figure 2:
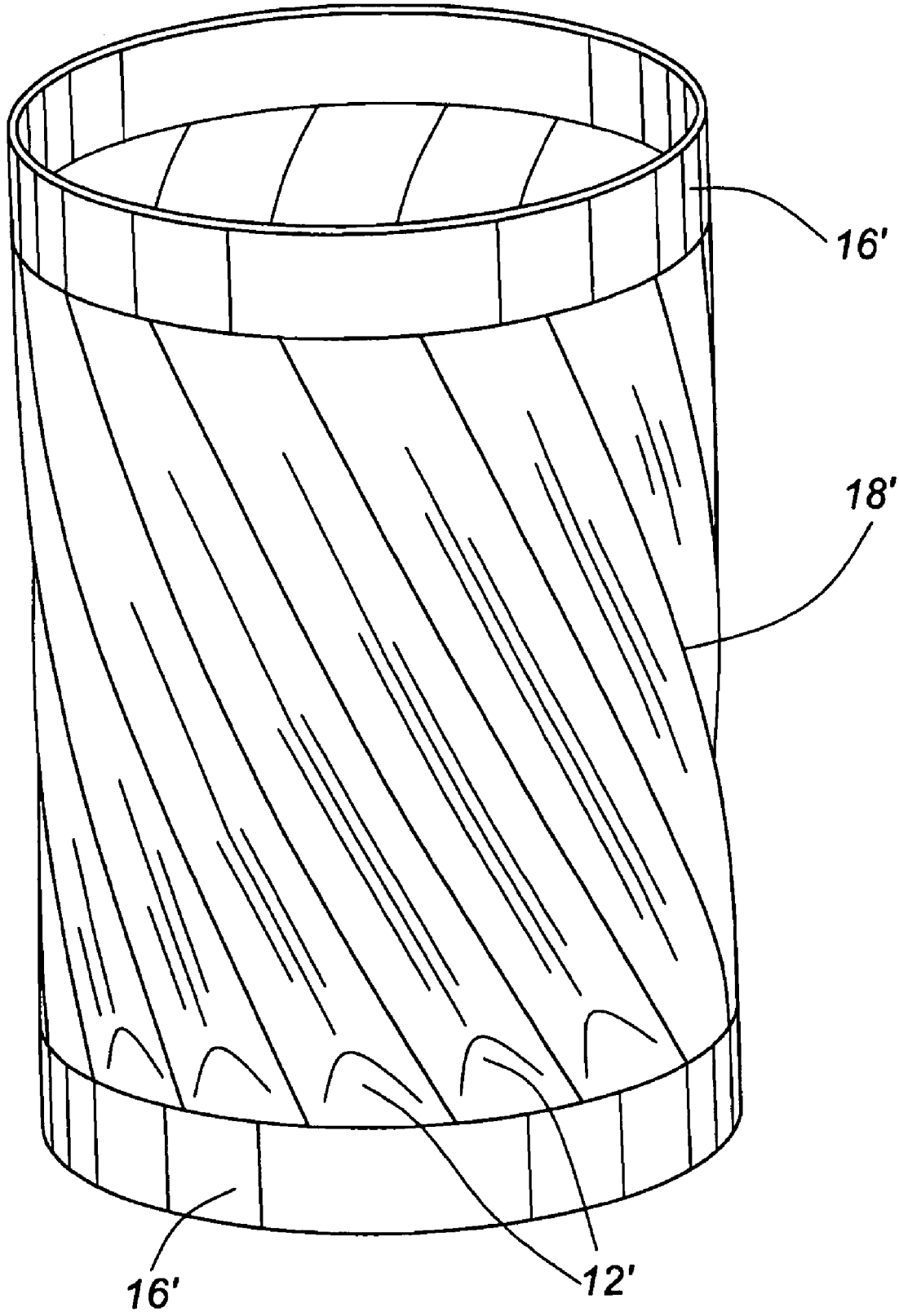
FIG. 2 is a perspective view of an acoustic projector according to the present invention, and FIG(. 3 is a graph showing the transmitting voltage response versus frequency for a prototype projector at a depth of 15 meters.

By twisting the shell of the existing folded shell projector between flanges 16' illustrated in FIG. 2, a radiating surface can be produced with helicoidal corrugations 12', such that a torque generated by a shear mode motor applied to the ends of the shell will result in a useful volume velocity. The transformer ratio of the shell can be varied over a wide range by altering the angle of twist, and other dimensions of the shell. This will result in high sensitivity, high coupling factor and increased bandwidth for the projector. This is illustrated in FIG. 2 wherein the shell 18' is twisted according to an embodiment of the present invention compared to shell 18 in FIG. 1.

Finite element calculations show that the twist angle of the shell of the shear mode projector should be in the range of 0.6 to 2.4 radian, in order for the projector to radiate sound efficiently. The definition of twist angle is the angular rotation of the shell surface that occurs from top to bottom of the folded portion of the shell.

A search and consultations with experts found no examples of sound projectors driven from shear mode motors. The motor could be made from conventional piezoelectric materials, single crystal relaxor ferroelectric materials, magnetostrictives, magnetic shape memory alloys, or a rotary electrodynamic (moving coil or moving magnet) motor, and the invention would work underwater or in air as a loudspeaker. The invention has the same number of parts as the folded shell projector, yet it works in a fundamentally different way. The projector would also function as a hydrophone of high sensitivity. As an air loudspeaker for home audio use, the spiral folds can be more visually appealing than the straight folds of the folded shell loud speaker.

A computer Mavart 3D finite element model of shear mode folded shell estimates the eigen frequencies of the shell for various twist angles of 0.6, 1.8 and 3.6 radians. The definition of twist angle is the angular rotation of the shell surface that occurs from top to bottom of the folded portion. The model indicates the shell will have a suitable low resonant breathing mode and that it will have a transformer action that will convert the torque from a shear mode motor to a useful volume velocity.

The corrugations have maximum fold depth at the center, which is 2 to 10 times the thickness of the shell. The thin walled shell may be formed of a material selected from the group of aluminum, ferrous metals, non-ferrous metals, plastics or composites.

Figure 3:
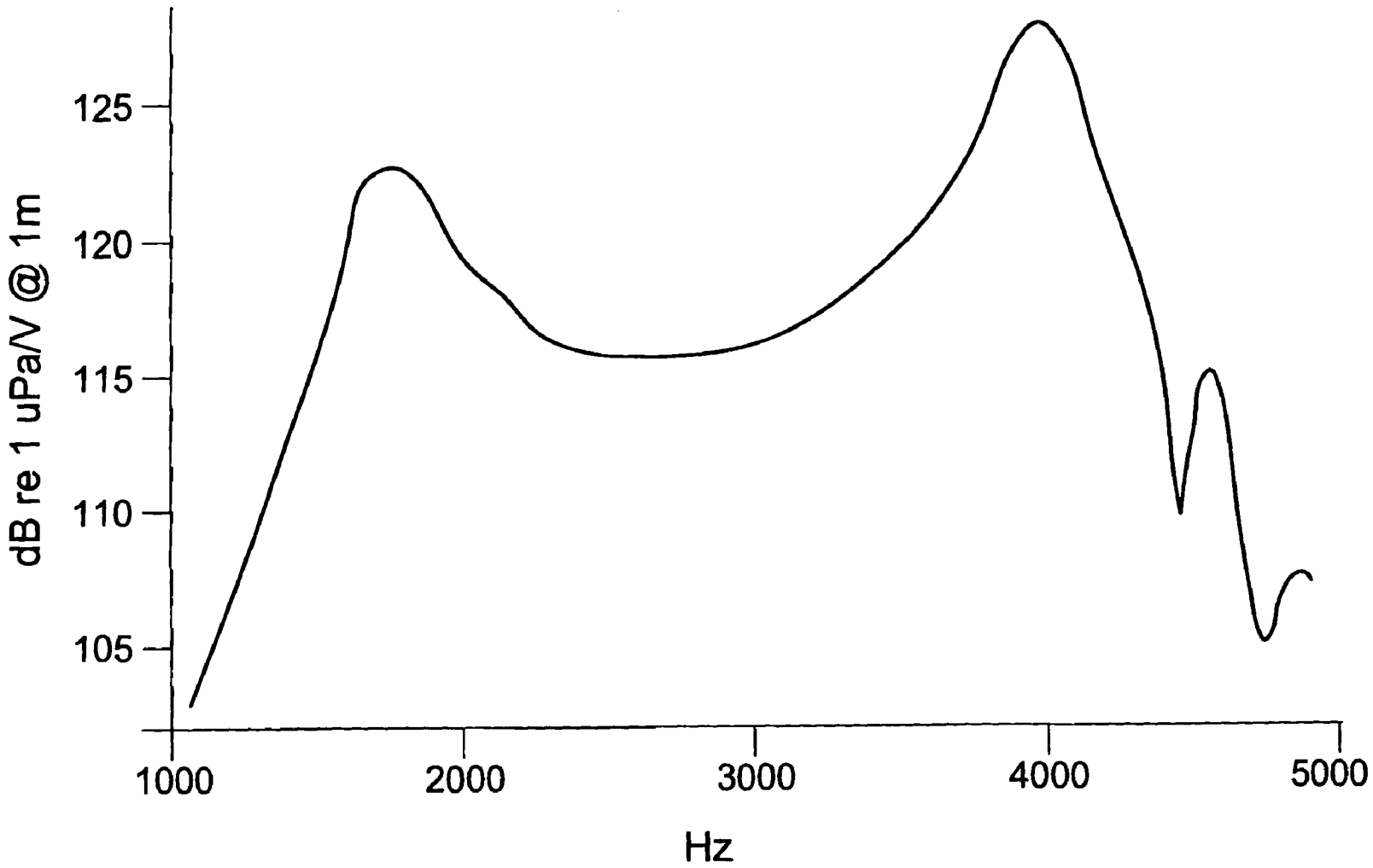

A prototype was formed having a titanium shell with 16 folds, a twist angle of 1.2 radians and a shell wall thickness of 0.8 mm, a fold depth of 7.5 mm, a diameter of 8.0 cm and titanium end plates thickness of 1.27 cm. The prototype total height was 12.7 cm with a total mass of 145.57 gm. The prototype was driven with over 500 volts RMS during testing and showed a wide bandwidth with high sensitivity, as anticipated, with a usable bandwidth of from 1500 Hz to 4000 Hz as illustrated in FIG. 3.

Various modifications may be made to the preferred embodiment without departing from the spirit and scope of the invention as defined in the appended claims.

The embodiment of the invention in which an exclusive property or privilege is claimed are defined as follows:

1. An acoustic projector comprising a thin walled shell extending between flanges having helicoidal corrugations extending between the flanges, a shear mode motor being coupled to the thin walled shell to provide a torque to the thin walled shell, the helicoidal corrugations having a maximum depth at the center of the corrugations that is 2 to 10 times the shell's thickness.

2. An acoustic projector as defined in claim 1, wherein the shear mode motor is one selected from the group of a piezoelectric motor, a single crystal relaxor ferroelectric motor, a magnetostrictive motor, a magnetic shape memory alloy motor or a rotary electrodynamic motor.

3. An acoustic projector as defined in claim 1, wherein the thin walled shell is formed from a material selected from the group of aluminum, ferrous metals, non-ferrous metal, plastics or composites.

4. An acoustic projector as defined in claim 2, wherein the thin walled shell is formed from a material selected from the group of aluminum, ferrous metals, non-ferrous metal, plastics or composites.

5. An acoustic projector comprising a thin walled shell extending between flanges having helicoidal corrugations extending between the flanges, a shear mode motor being coupled to the thin walled shell to provide a torque to the thin walled shell, the thin walled shell with helicoidal corrugations having a twist angle between 0.6 and 3.8 radians.

6. An acoustic projector as defined in claim 5, wherein the shear mode motor is one selected from the group of a piezoelectric motor, a single crystal relaxor ferroelectric motor, a magnetostrictive motor, a magnetic shape memory alloy motor or a rotary electrodynamic motor.

7. An acoustic projector as defined in claim 5, wherein the thin walled shell is formed from a material selected from the group of aluminum, ferrous metals, non-ferrous metal, plastics or composites.

8. An acoustic projector as defined in claim 6, wherein the thin walled shell is formed from a material selected from the group of aluminum, ferrous metals, non-ferrous metal, plastics or composites.

9. An acoustic projector comprising a thin walled shell extending between flanges having helicoidal corrugations extending between the flanges, a shear mode motor being coupled to the thin walled shell to provide a torque to the thin walled shell, in the shear mode motor being one selected from the group of a piezoelectric motor, a single crystal relaxor ferroelectric motor, a magnetostrictive motor, a magnetic shape memory alloy motor or a rotary electrodynamic motor, and in the thin walled shell having a diameter of 8.0 cm and being formed of titanium having 16 helicoidal corrugations between the flanges with a twist angle of 1.2 radians and a shell wall thickness of 0.8 mm, with a corrugation depth of 7.5 mm.

* * * * *